US006641854B2

(12) United States Patent
Gerhart et al.

(10) Patent No.: US 6,641,854 B2
(45) Date of Patent: Nov. 4, 2003

(54) SINGLE HANDED CONTAINER FOR MIXING FOODS

(75) Inventors: Mark Gerhart, Westminster, MD (US); Edward O'Brien, Eastampton, NJ (US); Simon Gainey, Wayne, PA (US); Robert Guldi, Kalamazoo, MI (US); Brian Wagner, Kalamazoo, MI (US); Mike Richmond, Kalamazoo, MI (US)

(73) Assignee: Kellogg Company, Battle Creek, MI (US)

( * ) Notice: Subject to any disclaimer, the term of this patent is extended or adjusted under 35 U.S.C. 154(b) by 0 days.

(21) Appl. No.: 10/282,877

(22) Filed: Oct. 29, 2002

(65) Prior Publication Data

US 2003/0054078 A1 Mar. 20, 2003

Related U.S. Application Data

(62) Division of application No. 09/617,676, filed on Jul. 14, 2000, now Pat. No. 6,528,105.

(51) Int. Cl.[7] ..... B65D 3/00; B65D 85/00

(52) U.S. Cl. ..... 426/394; 206/217; 215/6; 215/10; 220/501; 426/115; 426/120

(58) Field of Search ..... 426/394, 115, 426/120, 112; 206/217; 220/501; 215/10, 6

(56) References Cited

U.S. PATENT DOCUMENTS

| | | | | |
|---|---|---|---|---|
| 2,738,890 A | | 3/1956 | Dahl et al. | 215/6 |
| 2,963,194 A | | 12/1960 | Brennan et al. | 220/23.83 |
| 3,288,344 A | | 11/1966 | Woollen et al. | 229/7 |
| 3,450,254 A | | 6/1969 | Miles | 206/46 |
| 3,561,664 A | | 2/1971 | Palmer | 229/15 |
| 3,856,138 A | | 12/1974 | Maekawa et al. | 206/221 |
| 3,915,296 A | | 10/1975 | Spencer | 206/217 |
| 3,978,232 A | | 8/1976 | Dodsworth et al. | 426/115 |
| 4,018,904 A | | 4/1977 | Muraoka | 426/115 |
| 4,277,000 A | | 7/1981 | Jaarsma | 222/142.4 |
| 4,482,047 A | | 11/1984 | Ackermann et al. | 206/219 |
| 4,483,439 A | | 11/1984 | Steigerwald et al. | 206/219 |
| 4,582,197 A | | 4/1986 | Lin | 206/217 |
| 4,869,912 A | | 9/1989 | McCoy et al. | 426/123 |
| 4,928,848 A | | 5/1990 | Ballway | 220/444 |
| 5,215,214 A | | 6/1993 | Lev et al. | 222/1 |
| 5,318,183 A | | 6/1994 | Cohen et al. | 206/538 |
| 5,437,381 A | | 8/1995 | Herrmann | 215/11.1 |
| 5,496,575 A | | 3/1996 | Newarski | 426/115 |
| 5,588,561 A | | 12/1996 | Ness | 222/129 |
| RE35,437 E | | 2/1997 | Ascone | 62/372 |
| 5,706,980 A | | 1/1998 | Dickerson | 222/129 |
| 5,727,679 A | | 3/1998 | Newarski | 206/222 |
| 5,753,289 A | | 5/1998 | Ness | 426/394 |
| 6,085,927 A | * | 7/2000 | Kusz | 215/6 |

* cited by examiner

*Primary Examiner*—George C. Yeung
(74) *Attorney, Agent, or Firm*—Howard & Howard

(57) ABSTRACT

The invention discloses a method and an apparatus for a food container which includes an inner member (which can be a cup or a bottle) for holding a particulate food; an outer member (which can be a second cup or a second bottle) adapted to receive the inner member, with a space between the inner and the outer members, for a liquid food; where the inner member interlocks with the outer member and openings are provided for the discharge of the liquid food; and the particulate food and the liquid food can be consumed simultaneously by tilting the container towards the mouth of the user to discharge or withdraw particulate food from the inner member and liquid food from the outer member through the aperture.

8 Claims, 5 Drawing Sheets

SINGLE HANDED CONTAINER FOR MIXING FOODS

This application is a division of application Ser. No. 09/617,676, filed Jul. 14, 2000, now U.S. Pat. No. 6,528,105.

TECHNICAL FIELD

The present invention relates to a portable food container, and more specifically, a single handed container which consists of two separate containers holding two different food types which are mixed while eating.

BACKGROUND

Research shows that breakfast is the most important meal of the day. One of the most common breakfast foods is cereal. Cereal is typically placed in a container, milk is poured over the cereal, and the consumer consumes the mixture with a spoon. Cereal consumption normally requires two hands, and is not an activity which can be safely performed while the consumer is engaged in various other activities such as driving a vehicle.

In a move to make breakfast consumption more convenient, many manufacturers have offered breakfast bars, breakfast sandwiches and other breakfast foods which can be consumed with a single hand. There have also been several attempts to construct a container which stores cereal and milk separately, allows the two to be mixed when consumed and allows the consumer to eat the mixture with a single hand.

U.S. Pat. Nos. 5,588,561 and 5,753,289, issued to Ness, describe a container for holding cereal and milk in a separate compartments. Cereal is placed in the inner, inflexible container, while milk is placed in the outer flexible table. Cereal is shaken from the inner, inflexible, container into the consumer's mouth, and the consumer then squeezes the outer flexible container to squirt milk into the consumer's mouth. In this manner, the cereal and the milk are mixed inside the consumer's mouth. The Ness patents also require rotation of the portable food container to a dispensing position before the consumer can use the product. A need exists for a simplified single handed container, which will allow an individual to consume cereal and milk with a single hand while hiking, camping, driving, or while involved in other activities.

SUMMARY OF THE INVENTION

Accordingly, a need exists for a simplified, one handed container, which stores a dry particular food separately from a liquid food, and which allows the consumer to easily mix the two foods types without the need for rotation or squeezing.

These and other objects, features and technical advantages are achieved by a system which includes a food container which is comprised of an inner cup, for holding a particulate food, and an outer cup which is adapted to receive the inner cup within it in a manner in which a space is left between the two cups for holding a liquid food. The inner cup includes a flange that interlocks with the open end of the outer cup in a liquid tight manner. The flange has at least one aperture for discharging the liquid food. The particulate food and the liquid food are consumed simultaneously by tilting the container towards the mouth of the user to discharge the particulate food from the inner cup and the liquid food from the outer cup through the aperture. The particulate food can be a ready to eat cereal and may be of the non-flake type. The flange has a horizontal surface containing the aperture. The aperture may allow the liquid food to flow through it by gravity, or it may prevent the liquid food to flow through it unless a sucking force is applied to the aperture. An additional member may be included with the container which partially covers the opening of the inner cup and is used to regulate the discharge of the particulate food. The flange can also have a vent aperture. The outer cup is composed of a moisture resistant paper and the inner cup is made of plastic.

The objects, features and technical advantages are also achieved by a method of dispensing particulate food and a liquid food comprising providing an inner cup containing a particulate food and an outer cup adapted to receive the inner cup with a space there between, and where the space contains a liquid food. The inner cup has a flange which interlocks with the open end of the outer cup in a liquid tight manner and this flange has an aperture for discharging the liquid food. By tilting the container, both the particulate and the liquid food are simultaneously discharged into the mouth of the user. The particulate food is a ready to eat cereal and can be of the non-flake cereal type. The liquid food can be discharged through the aperture through gravity flow or may be sized to require the liquid food to be sucked from the aperture. The method can further include a mechanism to regulate the discharge of the particulate food from the inner cup.

Another embodiment of the present invention can include a food container which is comprised of an inner bottle for holding a particulate food and an outer bottle which is adapted to receive the inner bottle with a space there between the two bottles for holding a liquid food. The inner bottle can have a tripod member that interlocks with the closed end of the outer bottle. The outer bottle has at least one aperture for discharging the liquid food and the particulate food and the liquid food can be consumed simultaneously by tilting the container towards the mouth of the user to discharge the particulate food from the inner container and the liquid food from the outer bottle through the aperture. The particulate food is a ready to eat cereal and can be of the non-flake cereal type. The liquid food can be discharged through the aperture through gravity flow or may be sized to require the liquid food to be sucked from the aperture. The method can further include a mechanism to regulate the discharge of the particulate food from the inner cup. The tripod member can be comprised of a series of convex and concave portions in which the convex portion interlocks into a corresponding rim of the outer bottle and the concave portion provides additional space for holding the liquid food.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWING

For a more complete understanding of the present invention, and the advantages thereof, reference is now made to the following descriptions taken in conjunction with the accompanying drawing, in which.

DETAILED DESCRIPTION

Figure 1:
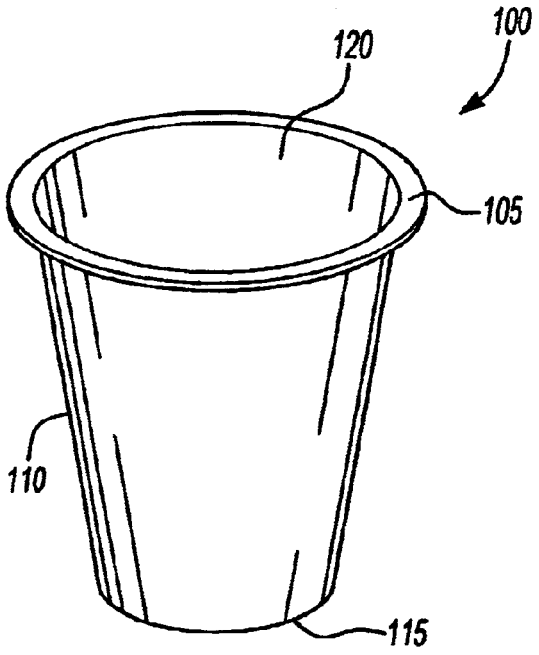
FIG. 1 is a diagram of an outer container of the cup-in-cup design of the current invention.
Figure 2:
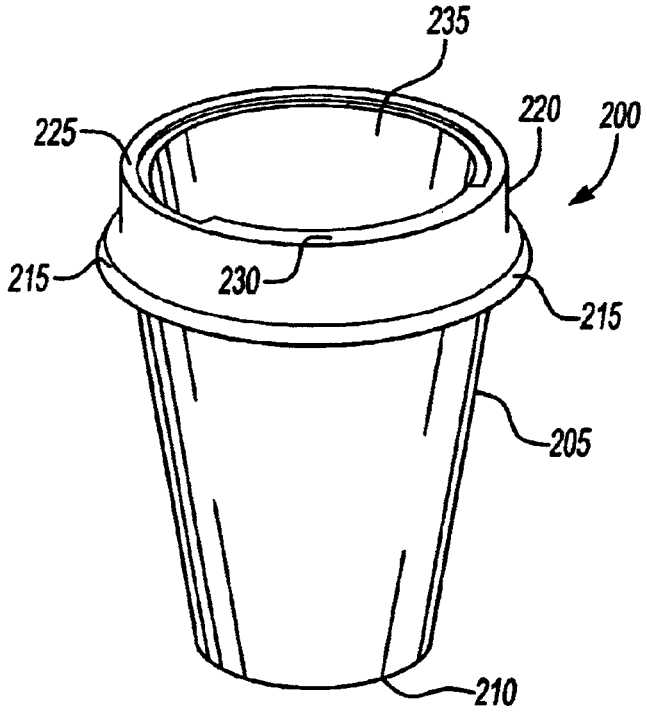
FIG. 2 is a diagram of an inner container of the cup-in-cup design of the current invention.

FIG. 1 shows an outer cup of a cup-in-cup design while FIG. 2 shows the inner cup of the same embodiment. Outer container 100 of FIG. 1 is composed of an upper lip 105, the sidewall 110, the bottom 115, and the inside 120. In a preferred embodiment, upper lip 105 is constructed of a rigid material, such as moisture proof cardboard. Similarly, sidewall 110 is constructed of a rigid material such as moisture proof cardboard or heavy paper. This rigid sidewall is not intended to be squeezed to force liquid from the aperture of the inner container (200 of FIG. 2). The bottom 115 is also constructed of a similar material. In normal operation, milk or a similar liquid food is placed inside 120, the container 100.

Inner container 200 of FIG. 2 is composed of a sidewall 205, a bottom 210, and attaching lip 215, a lip sidewall 220, an eating surface 225, and one or more vents 230. The sidewall 205 and the bottom 210 may be constructed of a rigid or a flexible moisture proof material. The attaching lip 215 must contain enough rigidity and flexibility to meet with and attach to lip 105 of the outer container of FIG. 1. The lip sidewall 220 connects the attaching lip 215 to the eating surface 225. The eating surface 225 is the portion of the inner cup 200 which makes contact with the consumer's lip. Vent 230 allows the milk or similar liquid contained within the inside 120 of outer cup 100 of FIG. 1 to pass into the consumer's mouth. Opening 235 of inner container holds particulate food, cereal or similar food substance.

Figure 3:
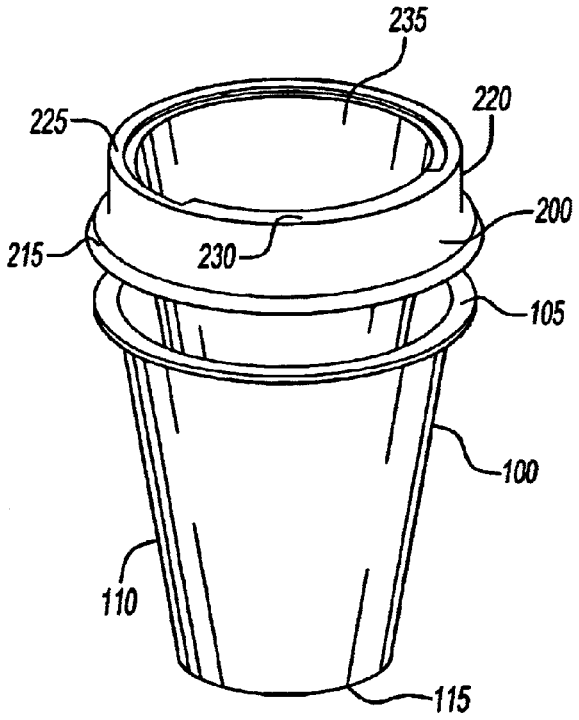
FIG. 3 is a diagram of the mating of the outer cup of FIG. 1 with the inner cup of FIG. 2.

Referring to FIG. 3, the interrelationship between the outer cup 100 of FIG. 1 and the inner cup 200 of FIG. 2 is shown. The inner cup 200 fits within the interior 120 of the outer cup 100. When the inner cup 200 is mated with the outer cup 100, the attaching lip 215 fits securely over lip 105 of the outer cup. When mated, the sidewall 205 and the bottom 210 of the inner cup 200 are contained within the inside 120 of the outer cup. The smaller diameter of the sidewall 205 of the inner cup, as compared to the larger diameter of the sidewall 110 of the outer cup, ensures that the inner cup 200 does not fill the entire opening 120 of the outer cup 100. This difference in diameters between the inner cup and the outer cup's sidewalls creates a space between the two containers and ensures that there is sufficient room inside the outer cup for a liquid such as milk. This liquid, contained within opening 120, of the outer container 100 can pass through the vent 230 of the inner cup into the consumer's mouth.

Figure 4:
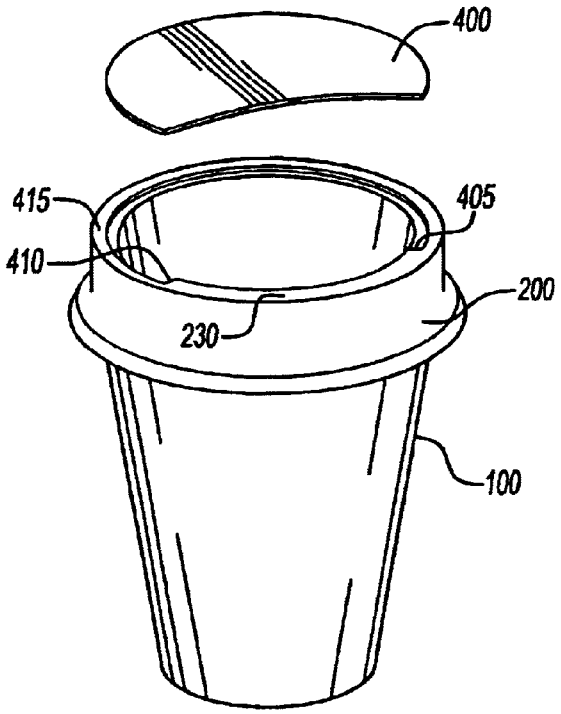
FIG. 4 is a drawing of the mated combination of FIG. 3 with an orifice reducer.

Referring now to FIG. 4, an orifice reducer 400 can be used to regulate the flow of the dry material, or particulate food, from opening 235 of the inner cup into the consumer's mouth. This orifice reducer 400 fits within a groove on the eating surface 225 of the inner container between point 405 and 410. Preferably, this groove 415, which the orifice reducer fits into, traverses around approximately three-quarters of the circumference of the eating surface 225. As depicted in FIGS. 2, 3 and 4, the vent 230 can be a single opening. Alternatively, the vent 230 can consist of several smaller openings. Preferably, a venting hole is also included around the circumference of the eating surface 225 to ensure that a vacuum is not created when liquid passes outside of the vent 230.

Figure 5:
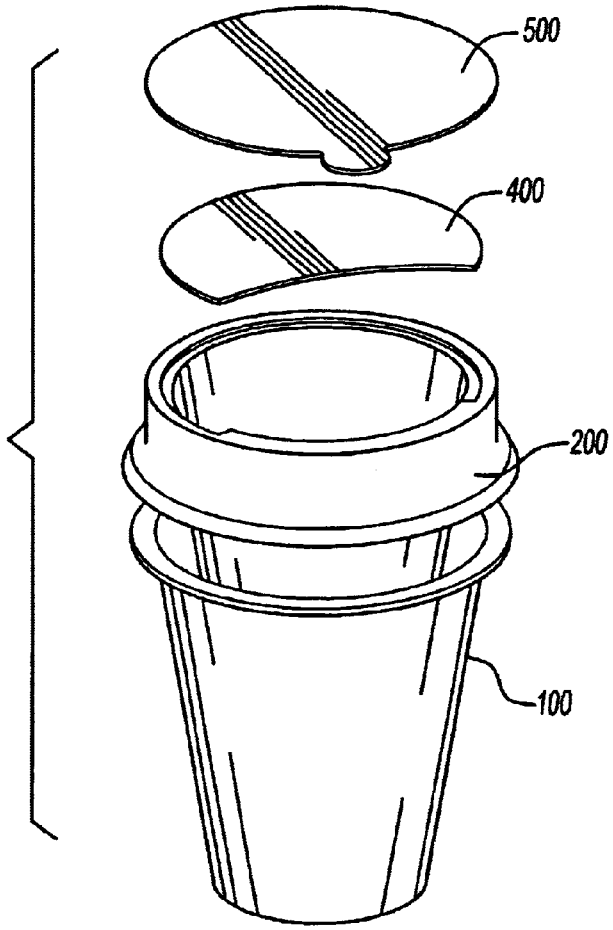
FIG. 5 is an exploded view of the cup-in-cup combination with the peel seal.
Figure 6:
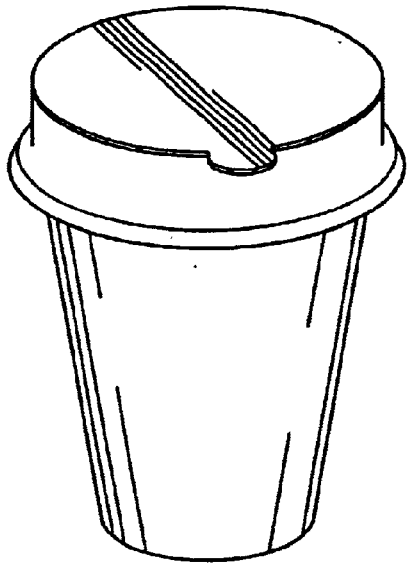
FIG. 6 is a drawing of the cup-in-cup design as sold.

FIG. 5 shows an exploded view of the single handed container which consists of the outside cup 100, the inside cup 200, the orifice reducer 400 and the peel seal 500. The peel seal 500 is used to ensure sanitary conditions of the single handed container when shipped. FIG. 6 illustrates the single handed container when it is ready for shipment.

In one embodiment of the single handed container, the volume of the outer container 100 is 14 fluid ounces, the volume of the inner container 200 is 9.5 fluid ounces, the diameter of bottom 115 of FIG. 1 is 2.5 inches, the top diameter along the lip 105 of FIG. 1 is 3.625 inches and the height of the outer container is 5 inches.

Figure 8:
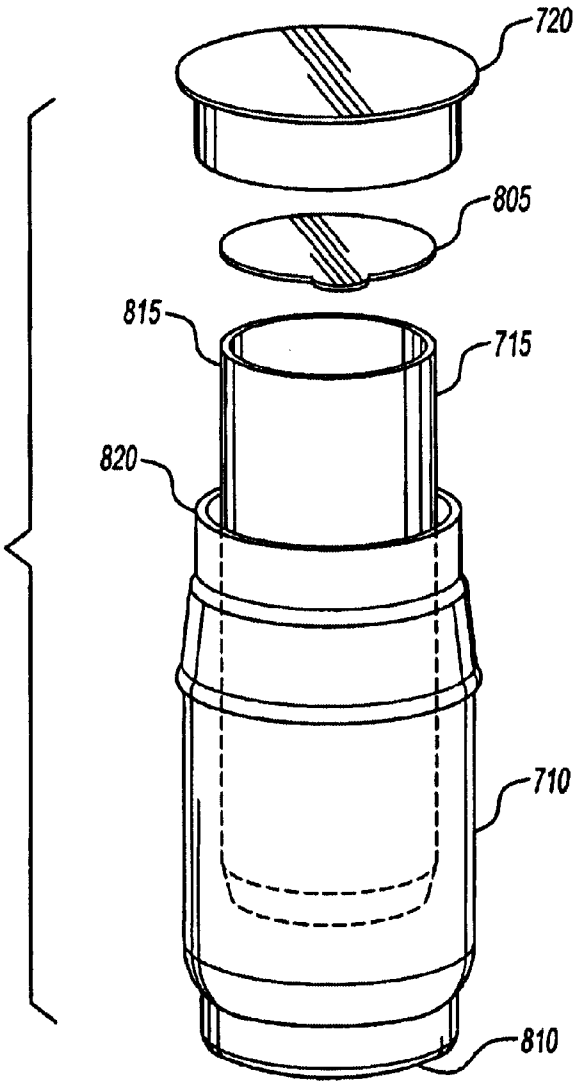
FIG. 8 is an exploded view of the bottle-in-bottle embodiment.
Figure 7:
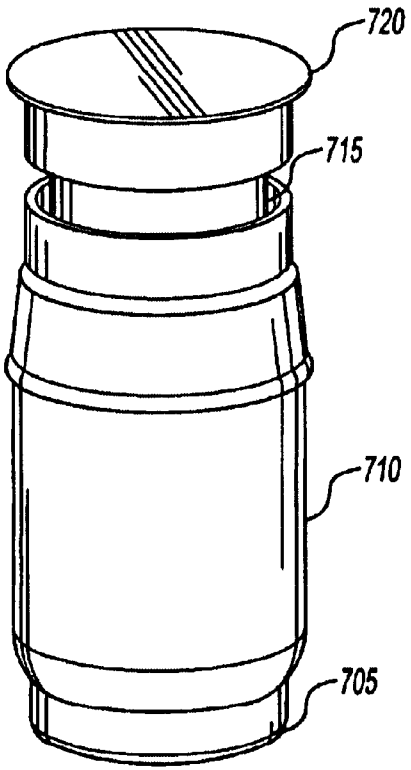
FIG. 7 is a diagram of the bottle-in-bottle embodiment of the current invention.

An alternative embodiment, the bottle-in-bottle configuration, of the present invention is shown in FIG. 7. In this embodiment, the invention consists of two separate bottles which snap together in the base at 705. This bottle-in-bottle embodiment includes the outer bottle 710, the inner bottle 715, and a snap cap 120. A peel seal, (not show in figure) can also be included to ensure non-contamination. This peel seal is shown in FIG. 8 as item 805. In a preferred embodiment of the bottle-in-bottle embodiment, the capacity of the outer bottle 710 is 14.5 fluid ounces, while the capacity of the inner bottle 715 is 9.5 fluid ounces. In a preferred embodiment of the bottle in bottle combination, the bottom diameter 810 of FIG. 8 is 2.5 inches while the top diameter 815 is 3.625 inches. The height of the overall container is 5 inches. In this bottle-in-bottle embodiment, the liquid contained in the outer bottle 710 is passed into the consumer's mouth through an orifice located on the inside diameter of the upper portion of the outside bottle 820. This orifice allows milk, or similar liquids to flow from the inside of the outer bottle into the consumer's mouth. The inner bottle holds the particulate food or similar food substance.

Figure 9:
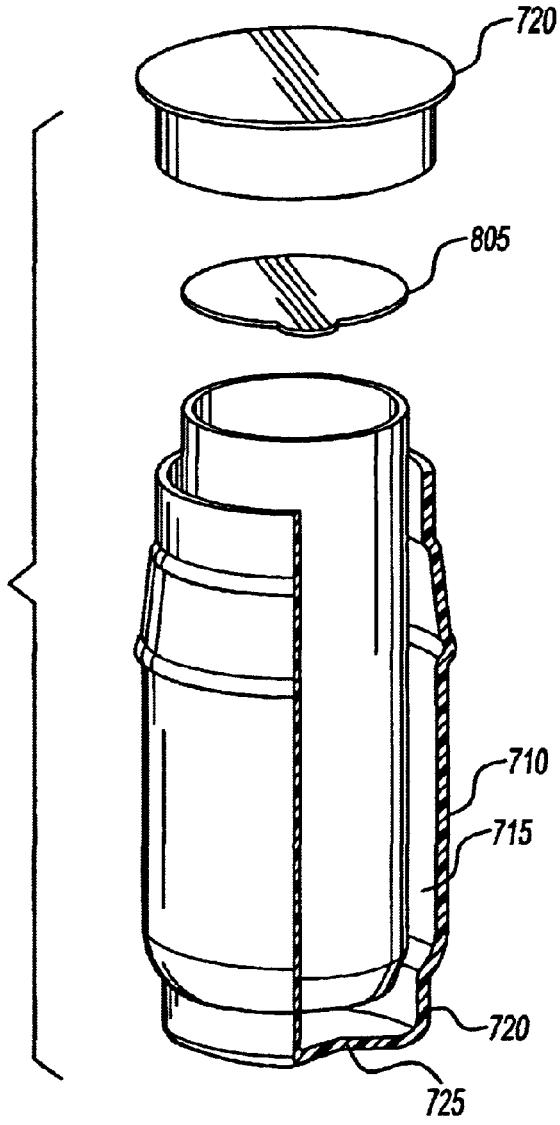
FIG. 9 is a cutaway view of the bottle-in-bottle embodiment.
Figure 10:
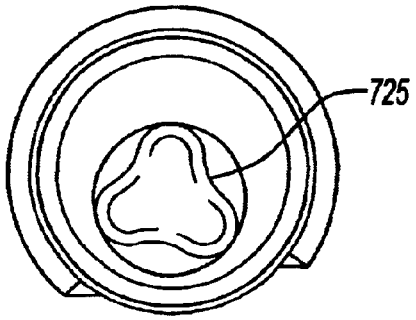
FIG. 10 is a diagram of the tripod shape of the base of FIG. 7's bottle-in-bottle embodiment.
Figure 11:
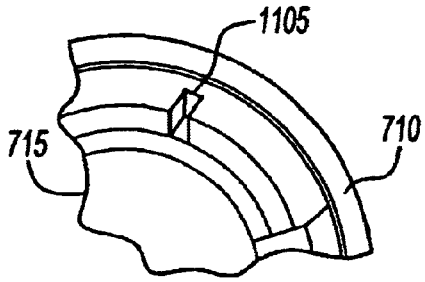
FIG. 11 is a drawing of the orifices used to pass milk from inside the outer bottle of the bottle-in-bottle embodiment.

Referring to the cutaway FIG. 9, the outer bottle 710 is shown with the inner bottle 715 in place. The snap fit between the outer bottle 710 and the inner bottle 715 is shown at 720. Additionally, the tripod shape 725 of the base of the inner bottle 715 facilitates milk flow from the space between outer bottle 710 and inner bottle 715 into the consumer's mouth. The tripod shape also provides additional space for the liquid food. FIG. 10 further shows the tripod shape 725.

As previously mentioned, orifice 1105 allows milk to flow from the inside of the outer bottle 710 along the outside of the inner bottle 715 and into the consumer's mouth. The size and the number of these orifices can be varied to regulate milk flow.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. Food container comprising:

(a) an inner bottle for holding a particulate food;

(b) an outer bottle for receiving said inner bottle with a space there between for holding a liquid food;

(c) said inner bottle having a tripod member that interlocks with the closed end of said outer bottle; and (d) said outer bottle having at least one aperture for discharging said liquid food;

whereby said particulate food and said liquid food can be consumed simultaneously by tilting the container towards the mouth of a user to discharge or withdraw particulate food from said inner bottle and liquid food from said outer bottle through said aperture.

2. The food container of claim 1 wherein said particulate food is a ready to eat cereal.

3. The food container of claim 2 wherein said ready to eat cereal is of the non-flake type.

4. The food container of claim 1 wherein said aperture allows liquid food to flow therefrom by gravity.

5. The food container of claim 1 wherein said aperture prevents liquid food to flow therefrom unless a sucking force is applied.

6. The food container of claim 1, further comprising a member partially covering the inner bottle to regulate the discharge of particulate food.

7. The food container of claim 1 wherein said outer bottle has a vent aperture.

8. The food container of claim 1 wherein said tripod member is comprised of a series of convex and concave portions in which the convex portion interlocks into a corresponding rim of said outer bottle and said concave portion provides additional space for holding said liquid food.

* * * * *